US005265781A

United States Patent [19]

Nichols

[11] Patent Number: 5,265,781

[45] Date of Patent: Nov. 30, 1993

[54] BELT OR WAISTBAND MOUNTABLE SUPPORT FOR ARTICLE CARRIER

[76] Inventor: Richard E. D. Nichols, 13223 Black Mountain Rd., #357, San Diego, Calif. 92129

[21] Appl. No.: 749,992

[22] Filed: Aug. 26, 1991

[51] Int. Cl.[5] ..... F41C 33/02

[52] U.S. Cl. ..... 224/198; 224/252; 224/911; 224/197

[58] Field of Search ..... 224/198, 911, 912, 252, 224/253, 197, 199

[56] References Cited

U.S. PATENT DOCUMENTS

| | | | |
|---|---|---|---|
| D. 240,225 | 6/1976 | Baker | D22/13 |
| D. 264,240 | 5/1982 | Bianchi | D22/13 |
| 653,779 | 7/1900 | Phillips . | |
| 814,599 | 3/1906 | Freyer . | |
| 837,156 | 11/1906 | Townsend . | |
| 881,044 | 3/1908 | Audley . | |
| 1,045,713 | 11/1912 | Lewis . | |
| 1,886,718 | 11/1932 | Noel . | |
| 1,887,780 | 11/1932 | Noel . | |
| 1,935,984 | 11/1933 | Noel . | |
| 3,168,972 | 2/1965 | Parlante et al. . | |
| 3,250,448 | 5/1966 | Clark . | |
| 3,300,109 | 1/1967 | Clark . | |
| 3,731,858 | 5/1973 | Baker . | |
| 3,902,639 | 9/1975 | Rogers . | |
| 3,915,361 | 10/1975 | Perkins . | |
| 4,253,592 | 3/1981 | Anderson | 224/198 |
| 4,424,924 | 1/1984 | Perkins . | |
| 4,504,001 | 3/1985 | Nichols | 335/198 |
| 4,619,020 | 10/1986 | Lecher, Sr. | 224/252 |
| 5,054,670 | 10/1991 | Gallagher | 224/191 |
| 5,100,036 | 3/1992 | Rogers et al. | 224/244 |

OTHER PUBLICATIONS

Hellweg International Brochure, pp. 8-9.
Safariland Duty Gear Brochure, pp. 85, 97, 108 and 143.
Dan Hume Leathergoods Brochure, p. 4.
Safety Speed Holster, Inc. Brochure, p. 8.
Mixson Brochure, p. 4.
Horseshoe Brochure, p. 9.
Bianchi International 1991 Catalog, pp. 18, 20, and 23.
Galco International 1990-1991 Catalog, pp. 19 and 26.
Brauer Bros. 1991 Catalog, p. 10.
Strong Holster 1991 Catalog, p. 5.
Michaels of Oregon Police Products 1990 Flyer and Price List.
Michaels of Oregon Catalog 1992, p. 5, (product available since 1990).

*Primary Examiner*—Linda J. Sholl
*Attorney, Agent, or Firm*—Brown, Martin, Haller & McClain

[57] ABSTRACT

A mounting device for suspending a holster or other article carrier from a wearer's waistband or belt is a U-shaped paddle member in one version for hooking over a wearer's waistband, and a plate with slots for receiving a belt in another version. Both the plate and one leg of the paddle member are provided with a pivot opening for receiving a first, pivotal fastener for pivotally connecting the devices to a holster, and a pair of arcuate slots positioned symmetrically one on each side of the pivot opening for receiving a pair of releasable fasteners for securing the holster in a selected angular position. The other leg of the paddle member is of arrowhead-like shape with its free end slightly pointed for easy insertion into the waistband, and a pair of inwardly directed barbs for fitting under the waistband to resist inadvertent pulling up and dislodging of the member. The plate can be rotated 180 degrees when the releasable fasteners are removed between a high ride and a low ride position.

26 Claims, 3 Drawing Sheets

BELT OR WAISTBAND MOUNTABLE SUPPORT FOR ARTICLE CARRIER

BACKGROUND OF THE INVENTION

The present invention relates to a suspending or hanging device for suspending an article carrier such as a handgun holster or carrier for articles such as gun cartridges, flashlights or the like from a wearer's waistband or belt.

Article carriers such as gun holding holsters are typically carried on a wearer's body in a number of possible ways. One technique is a shoulder harness for carrying a gun concealed below the wearer's arm. It is also known for guns to be carried in a wearer's pocket. Finally, gun holsters may be suspended from a wearer's belt, or may be suspended from the waistband of the wearer's clothing. In this case, the gun can be concealed beneath a jacket, for example, if worn to one side of the wearer's body. Various devices are known for suspending gun holsters from a belt or waistband, including belt loops for encircling a belt, allowing a holster to be worn inside or outside the waistband, metal spring clips for engaging over a belt or waistband, and paddles attached to the rear of the holster for hooking over a belt or waistband.

One of the most desirable factors in a suspending device for carrying a holster at the waistband is the capability to adjust the position and angle of the holster. The optimum position and angle to allow for rapid drawing of the gun will vary from individual to individual, and thus adjustability is very important. The ability to draw a gun quickly and smoothly is extremely critical for law enforcement personnel, for example, who must be prepared to encounter life-threatening situations on a daily basis. Angle adjustability is also important to allow adjustment for the wearer's stance, for example from a straight down orientation when the wearer is in a standing position to a forward orientation when the wearer is sitting. Simple pivoting devices have been provided on holster suspending belt loops for this purpose. However, these arrangements typically do not meet the challenge of providing an adjustable and fixable angle in a device for carrying a holster at the waistband which is compact and stable enough for effective concealment.

One example of a pivoting belt loop adjustment is described in U.S. Pat. No. 3,168,972 of Parlante. In this case, a simple swivel joint is provided between the belt loop and holster. However, the holster is not securely held in the selected angular position and thus may move around during strenuous activity by the wearer, for example. U.S. Pat. No. 4,504,001 of Nichols describes a belt loop connected to a holster by an adjustable swivel connector. In this case, the holster angle may be adjusted by loosening a central screw, allowing relatively rotatable dimpled plates to be ratcheted relative to one another until the desired orientation is reached, after which the screw is tightened.

It is also desirable for the ride height of a holster to be adjustable to allow for different body types, from men to women and heavy build to light build, so that the wearer can adjust the holster height for optimum comfort, draw position, as well as concealability where the gun is to be carried concealed. Typical belt loops allow no height adjustment. Typical arrangements for carrying holsters at different heights include providing different slots on the holster so that it can be secured to the carrying device at different positions. However, adjustment is difficult and inconvenient to achieve in this case, requiring partial disassembly of the holster to achieve the adjustment. Also, such arrangements do not allow for the variation in body contours between different individuals. Paddles typically do not conform to a wide range of different body sizes, shapes and contours, from men to women and from thin to heavy. Thus, paddles can be pushed out by the wearer's natural body contours, making them uncomfortable and difficult to conceal.

Another problem which occurs in paddle type carrying devices is that they are typically very unstable. The advantage of the paddle is that it can be used regardless of whether the wearer is wearing a belt. However, since it simply hooks over the wearer's belt or waistband, it is not particularly stable, and can even be pulled out of the waistband when the wearer draws the gun from the holster. Also, such devices often become dislodged during any strenuous activity such as running or climbing, which law enforcement personnel often have to do when pursuing suspects. Attempts to provide some means to hold the paddle firmly inside the waistband have frequently been inadequate. For example, some paddles have straps which are intended to be secured around a belt for retention purposes. However, this does not overcome the problem of instability of the paddle itself, and is also ineffective unless a belt is worn at all times. Such paddles also typically do not allow the holster to be worn at an optimum, fixable angle. Due to their inherent instability, paddles may slip from a desired position to place a holster at an awkward angle, potentially making the draw of the gun substantially slower than normal, which may place the wearer at risk.

Other attempts to increase stability in paddle devices have involved increasing the paddle width, use of high friction materials, and provision of a spring clamping action. For example, U.S. Pat. No. 4,424,924 of Perkins describes a wire form, spring clip paddle which is easy to insert in the pants in practice but difficult to remove. The wire form can be uncomfortable, and still does not provide the desired degree of stability. U.S. Pat. No. 3,915,361 of Perkins describes a holster mounting clip or paddle secured to the holster via a swivel connector. The paddle is a relatively wide plate formed in a slightly inverted U-shape and dipped in a high friction, rubber-like material. The high friction material is the sole means for retaining the holster in the pants, and does not avoid the risk of the holster being pulled out accidentally when the gun is drawn, for example.

Other techniques for retaining a paddle have included hooks formed on the inner side of the holster. However, this does not avoid the risk of the holster rocking from side to side, and is also very abrasive on the wearer's clothing. This type is typically difficult to remove when the user no longer wishes to wear it, since it may catch on the clothing when being pulled up.

SUMMARY OF THE INVENTION

It is an object of the present invention to provide a new and improved mounting device for suspending a holster or other article carrier from a waistband or belt.

According to one aspect of the present invention, a belt mountable holster or carrier is provided which comprises a holster body having a handgun receiving pouch, a plate member having a pair of aligned, belt receiving openings for slidably receiving a wearer's belt extending through the openings, a swivel connector pivotally connecting the plate member to the holster body for selective angular positioning of the holster body relative to the plate member, and a fastener device for releasably securing the holster body in a selected angular position relative to the plate member.

In one example the plate member comprises a single panel or plate having opposite side edges and opposite first and second edges extending between the side edges, and the belt receiving openings comprise a first slot adjacent one side edge of the plate and a second slot adjacent the opposite side edge of the plate. Preferably, the swivel connector is located centrally between the side edges and closer to the first edge than the second edge of the plate, and allows 360 degree rotation of the plate when the fastener device is released. This allows the ride height of the holster relative to a belt to be adjusted between a high riding and a low riding position, simply by inverting the plate. When the plate is positioned with the first edge uppermost, the holster is carried higher relative to the belt since it is secured to the swivel connector which in turn is closest to the first edge. If the plate is inverted from this position with the first edge lowermost, the holster, which is secured to the plate closer to the first edge, will be carried lower. Thus, a single belt loop attachment or mounting device allows for two possible holster ride height positions by a quick and simple adjustment.

Preferably, the plate has a pair of symmetrically arranged, arcuate slots positioned one on each side of the swivel connector, and the fastener device comprises a pair of releasable fasteners such as screws or the like extending through the respective arcuate slots and releasably connected to the holster body. In order to adjust the angular orientation of the holster body relative to the plate, and thus relative to the belt on which the plate is mounted, the fasteners are loosened, and the holster body is pivoted about the swivel connector, with the fasteners travelling along the slots in opposite directions until the desired orientation is reached, after which the fasteners are tightened. This allows continuous adjustability over a range of useable angles from rear rake through vertical to forward rake, with the range of angular adjustment being limited by the length of the slots. Because of the symmetrical positioning of the slots, the ride height of the holster is not changed by adjustment of its angular orientation. Additionally, the same device may be used both for left handed and right handed holsters.

In another embodiment of the invention, the plate member is formed or bent about a fold line into a U-shaped channel having a first leg on one side of the channel for hooking over a belt or waistband, and a second leg on the other side of the channel which is pivotally connected to a holster or other article carrier. The first leg or paddle is preferably of spade- or arrowhead-like shape and pointed at its free end, facilitating placing of the paddle into the wearer's waistband. The second panel or leg of the U-shape is preferably shorter than the first leg, allowing the device to be mounted relatively high on the holster and permitting the holster to be carried relatively low from the waistband. Preferably, the first panel has at least one inwardly and upwardly facing prong or hook formed at one of its side edges at a location just under the belt line for engaging under the wearer's belt or waistband. Prongs are preferably formed at each side edge of the panel, with the panel being wider than the holster body at this point so that the prongs are outboard of the holster body, allowing the prongs to ride easily into the waistband and under the belt as the device is inserted. This will prevent inadvertent freeing of the device from the waistband as the pistol is pulled out of the holster.

The channel-like paddle member is held securely by the prongs against inadvertent removal in an upwards direction when the gun is drawn, for example, while it can be removed easily when desired simply by rotating the device to release one of the prongs.

preferably, the pivotal connection to the holster body includes adjustable fasteners for fastening the holster body at a selected angle relative to the mounting device. In a preferred embodiment, the shorter leg of the channel member is pivotally connected to the holster body via a central pivot member, and has a pair of symmetrically arranged, arcuate slots positioned one on each side of the pivot member. Releasable fasteners extend through each of the arcuate slots to releasably secure the holster body to the channel member at a selected angle. When released, the fasteners can travel in opposite directions along the slots between the ends of the slots which act as stops, as the holster body is rotated about the central pivot member. When the selected angle is reached, the fasteners are tightened. Preferably, the longer leg of the channel member has openings overlying the slots in the shorter leg to allow access to the fasteners for adjustment purposes.

The mounting device of this invention allows a holster body to be suspended reliably from the wearer's belt or waistband and to be orientated securely at the wearer's desired draw angle. Adjustments can be made quickly and easily if necessary in the field. It is preferably contoured to follow the body contours of the wearer for added comfort.

BRIEF DESCRIPTION OF THE DRAWINGS

The present invention will be better understood from the following detailed description of some preferred embodiments of the invention, taken in conjunction with the accompanying drawings, in which like reference numerals refer to like parts, and in which.

DESCRIPTION OF THE PREFERRED EMBODIMENTS

Figure 3:
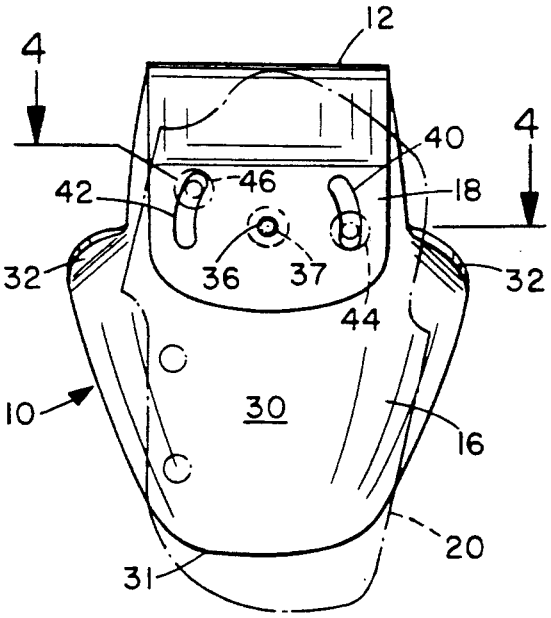
FIG. 3 is an outside view of the paddle, with the holster in broken line for clarity.
Figure 4:
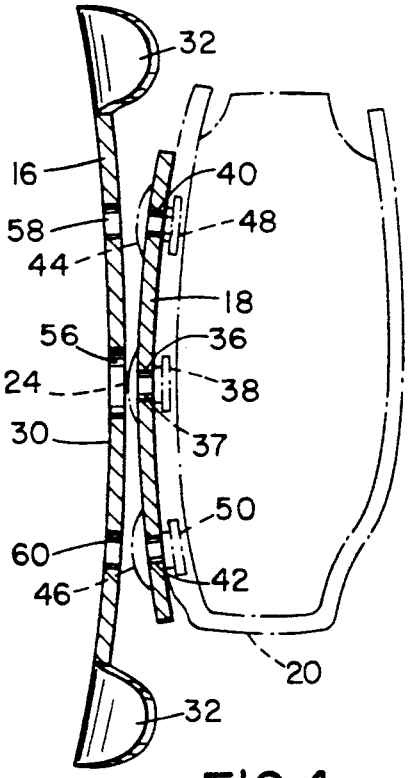
FIG. 4 is an enlarged sectional view taken on line 4—4 of FIG. 3.
Figure 5:
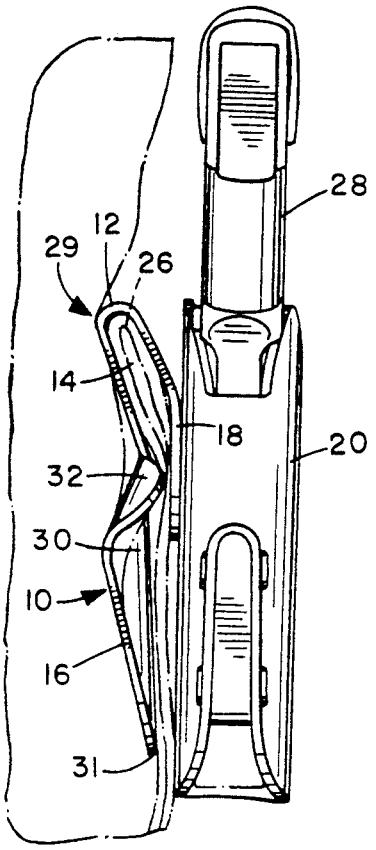
FIG. 5 is a view similar to FIG. 2, showing the complete unit as worn on a belt or waist portion of a garment.

FIGS. 1 to 6 of the drawings illustrate a holster mounting device in the form of a waistband or belt mountable paddle 10 according to a first embodiment of the present invention. The paddle 10 basically comprises a plate of a suitable rigid plastic or leather which is folded about a fold region 12 to form a U-shaped channel 14 having a first planar leg 16 which is longer than the second planar leg 18 of the U-shape. A suitable standard type of holster 20 is pivotally secured to the second, shorter leg 18 via a adjustable pivotal connection 24, while the first leg is designed to hook over a wearer's waistband 26 or belt as generally illustrated in FIG. 5 to suspend a handgun 28 in the holster from the waistband. The device 10 may be used for mounting any standard belt or waistband holster, or any other article carrier normally carried at the waist, such as carriers for gun cartridges, flashlights, nightsticks, or the like.

The first leg or panel 16 of the paddle is not flat but is contoured to form an outwardly facing concavity or arched depression 30 in its central region which will fit snugly and comfortably against the wearer's rounded body contours between the waistline 29 and hips, as indicated in FIG. 5. The U-shaped paddle member is curved or bent inwardly at its upper end adjacent the fold region 12, as best illustrated in FIGS. 2 and 5, which also follows the inward contours of the human body at the waistline for added comfort and stability.

The panel 16 is of generally spade- or arrowhead-like shape, and has an upper end secured to the first leg 18 and a lower or second end 31 which is narrower than remainder of the panel or leg and being slightly pointed. This allows the leg to be guided and inserted more easily into the waistband of clothing. The panel 16 is shaped at its opposite side edges just under the belt line to form a retention device comprising a pair of aligned, inwardly directed projections or prongs 32 spaced below fold region 12. The prongs 32 are positioned outboard of the side edges of the second leg 18 which is narrower than the first leg in this region, as best illustrated in FIG. 3, and will also be located outboard of an attached holster. The prongs 32 are intended to engage the underside of the wearer's belt or waistband 26, as illustrated in FIG. 5, to prevent the paddle from being inadvertently pulled out on drawing the handgun.

Figure 2:
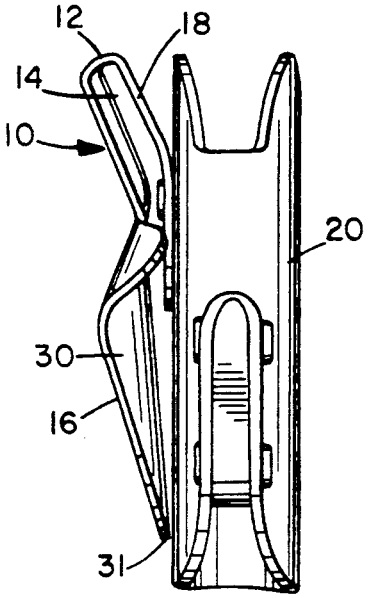
FIG. 2 is a side elevation view of the paddle and holster, as taken from the right hand side of FIG. 1.

As best illustrated in FIG. 2, the prongs 32 overlap the opposite side edges of the second leg 18 of the U-shaped paddle to form an open ended channel through which a belt can be passed if it is desired to mount the holster from a belt rather than the waistband of clothing. One prong only at one side of the paddle leg 16 may be provided in an alternative version, although it is preferred that two prongs are provided for increased stability. The paddle is narrower at the fold line than at the prongs 32 and will fit easily between a wearer's belt loops without any interference.

The adjustable pivotal connection 24 securing the shorter paddle leg 18 to the holster allows controlled angular rotation of the holster relative to the paddle. As illustrated in FIGS. 3 and 4, leg 18 has a central pivot opening 36 through which headed pivot pin or screw 37 extends for connection to a boss or nut 38 in holster body 20. A pair of arcuate slots 40, 42 are positioned symmetrically one on each side of the central opening 36, and a pair of screws or other adjustable fasteners 44, 46 extend through the respective arcuate slots and are adjustably fastened at their free ends to similar nuts or bosses 48, 50 embedded in holster body 20, as illustrated in FIG. 4. When released or loosened, the screws 44 and 46 can slide in opposite directions along slots 40, 42 between stops defined by the opposite ends of the respective slots. The opposing, longer paddle leg 16 has an opening 56 and symmetrically arranged arcuate slots 58 and 60 aligned with the respective underlying pivot opening 36 and arcuate slots 40, 42 for access to the underlying heads of the mounting screws or fasteners 37, 44, 46.

The three screw pivotal connection 24 allows the orientation of the holster relative to the paddle to be adjusted between a central position in which the handgun is carried upright or generally vertically and forward or rearward rake positions in which the gun is inclined to the front or to the rear of the wearer's body at any angle between the central or vertical position and a predetermined stop position as defined by the ends of the arcuate slots. Thus, the angle subtended by the arcuate slots defines the range of angular adjustment possible and this will be limited to the range of useful and useable draw angles. In a preferred embodiment, the range of angular adjustment from the vertical orientation was $\pm 30°$.

In order to adjust the orientation of the holster, and thus the draw angle of a handgun in the holster, the two outermost screws 44 and 46 are loosened via the access slots 58 and 60 in the overlying paddle leg 16. The holster body can then be pivoted either clockwise or anti-clockwise about the central screw or pivot pin 37, which may also be loosened if desired. As the holster body is rotated relative to the paddle, the screws 44 and 46 will travel in opposite directions along the respective slots 40, 42, as illustrated in FIG. 3. Because of the symmetrical arrangement of the slots, the ride height of the holster on the paddle remains unchanged as the angle is adjusted. The extent of angular adjustment possible is defined by the ends of the arcuate slots, which act as stops. Between the opposite ends of the slots a continuous range of angular adjustment is possible, so that the holster can be positioned at any angle between the angular positions at opposite ends of the range defined by the opposite ends of the slots. When the ideal angle has been selected, the screws are re-fastened to hold the holster body securely at the selected angle.

Although the paddle is preferably secured to the holster or other article carrier via a three-pin pivotal connector as illustrated in the drawings, other types of pivotal fasteners may alternatively be used, such as a ratcheting pivot or a pair of rotatable plates having mating dimples and recesses, as described in U.S. Pat. No. 4,504,001 of Nichols.

Figure 1:
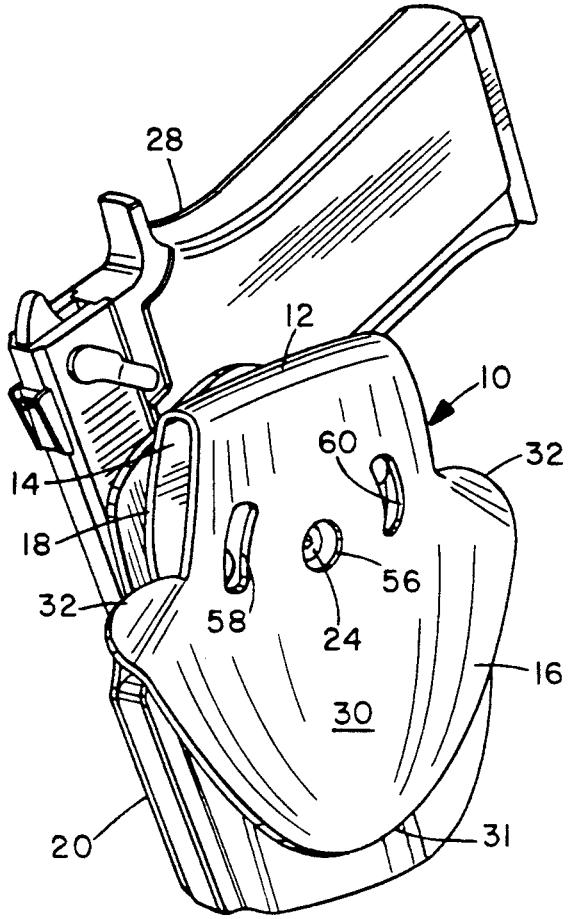
FIG. 1 is a perspective view, from the inside, of a holster mounting device in the form of a waistband mountable paddle, according to a first embodiment of the invention, with a typical holster attached and a pistol in place.
Figure 6:
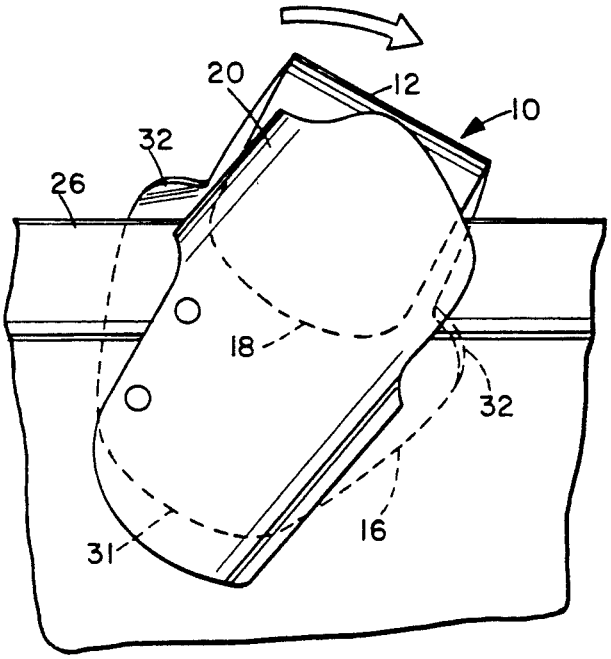
FIG. 6 illustrates the method of removing the paddle from the garment.

The pointed free end of the longer leg 16 of the paddle makes it easier to insert into the wearer's waistband. The prongs are also shaped in a manner similar to arrow barbs so that they can be inserted easily but then cannot be pulled out. As best illustrated in FIG. 1, the shape of the paddle is similar to that of an arrow head but with the prongs or barbs bent inwardly. As the paddle leg 16 is inserted, the prongs ride easily into the trousers and under the belt or waistband. Once the paddle leg 16 is fully inserted, the prongs extend inwardly to engage underneath the belt line and resist upward movement of the paddle, as illustrated in FIG. 5. After insertion, the paddle will not be easily or inadvertently freed from the waist by a pull upward on the pistol, for example. At the same time, the paddle can be withdrawn from the clothing relatively easily when desired simply by gripping the holster, pulling the belt line or waistband away from the body, and rotating the paddle as generally illustrated in FIG. 6 to release one of the barbs or prongs from the clothing. The paddle can then be easily removed. The removal process is so deliberate that any possibility of the paddle and attached holster being inadvertently detached from the waistband is substantially eliminated. Thus, a direct upward pull or inadvertent movement will not dislodge the paddle, but at the same time the paddle will be unlikely to damage clothing and can be removed relatively easily when necessary.

When the paddle is fully inserted in the clothing, the prongs are positioned outboard one on each side of the holster body, which will not bear against them causing potential abrasion of the intervening clothing. Thus, the clothing will have a longer life.

The paddle shape is well suited to the shape of a wide range of wearer's hips, since it is narrower at the bottom and curved to follow the normal body curvature from waistline to hips. It will fit well to the body contours of a range of wearers from thin to heavy, and is therefore relatively comfortable and easily concealable. It can also be used by either right or left handed wearers.

Figure 7:
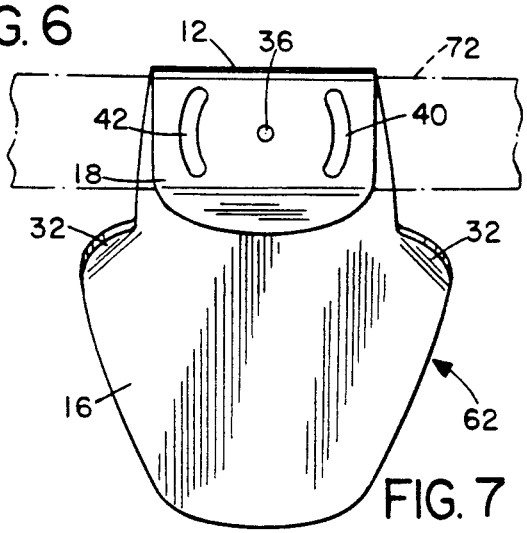
FIG. 7 is a view similar to FIG. 3, showing a modified paddle having an alternative high position for the holster mounting holes.

With this paddle arrangement of a U-shaped integral paddle with one shorter leg and one longer leg, the paddle can be mounted higher on the holster body than other paddle types, allowing the holster to be carried relatively low on the hips, which is more comfortable for shorter individuals as well as women. FIG. 7 illustrates a modified, high riding paddle 62 which is more suited for taller, straighter-hipped individuals, typically men. In FIG. 7, the pivotal connection opening and slot arrangement is identical to that of the previous embodiment, and like reference numerals have been used where appropriate, but the pivot opening 36 and adjustment slots 40 and 42 are provided higher up on the shorter leg 18 of the paddle 62 and closer to the fold region 12 which will lie at the waistband. In this case, the handgun will be carried higher as is desired by some individuals, for example taller people generally need to carry their handgun higher than small individuals for comfort and easy drawing, as well as to make the weapon easier to conceal. Also, men normally prefer to carry a gun higher than women, who may prefer to carry a holster low on the hips. Thus, the high riding paddle of FIG. 7 may be manufactured with an inner paddle leg 16 having the same basic arrowhead-like shape with barbs or prongs 32 as in the previous embodiment, but with reduced curvature. Instead, leg 16 is substantially flat to fit a straight hipped man, while the contours of the low riding paddle of FIGS. 1 to 6 are designed to fit comfortably against the hips.

Figure 8:
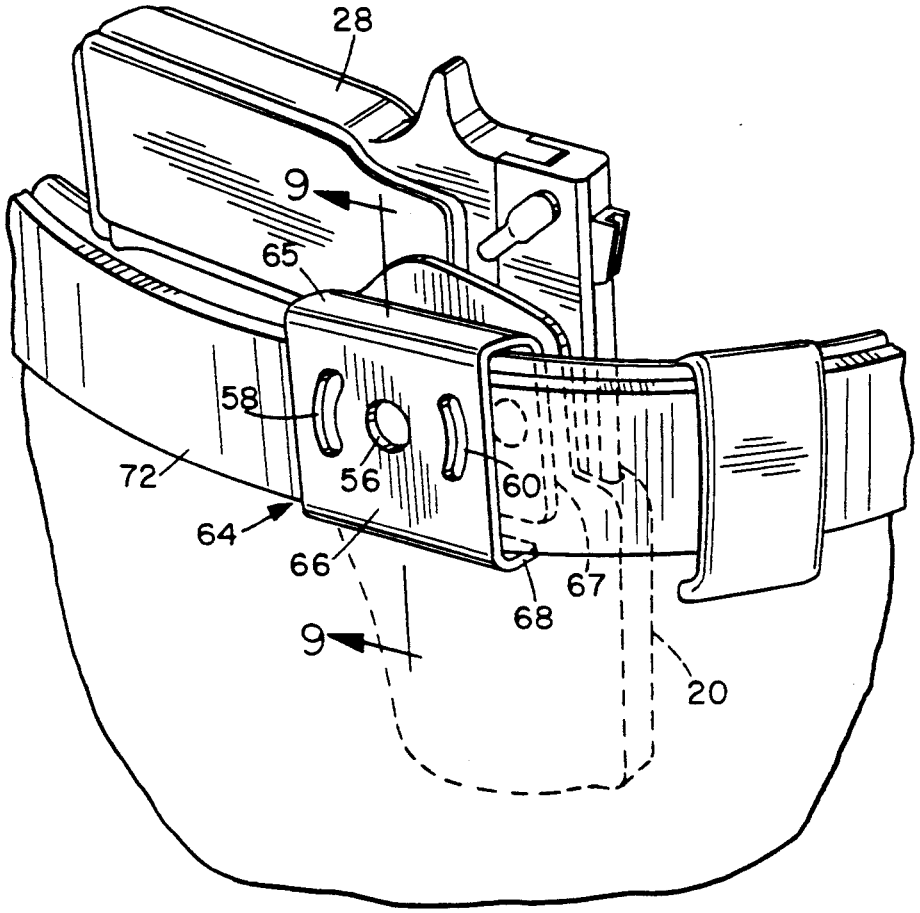
FIG. 8 is a perspective view illustrating a mounting device according to another embodiment of the invention as worn with a holster carried inside the waistband.
Figure 9:
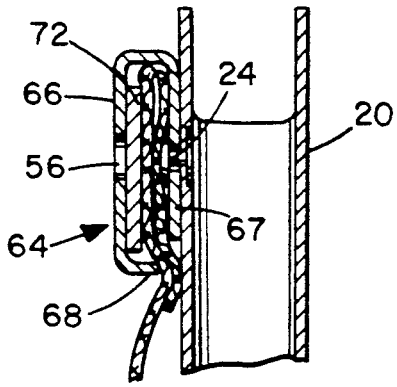
FIG. 9 is a section on the lines 9—9 of FIG. 8.

Although the paddle illustrated in the previous embodiments is designed to be hooked into the waistband with the holster or other carrier worn outside, it may alternatively be worn the other way around with the holster or other carrier worn inside the waistband or belt. FIGS. 8 and 9 illustrate a paddle 64 according to a further embodiment of the invention designed to support a holster or other carrier inside the waistband. The paddle 64 is similar to that of the previous embodiments, and like reference numerals have been used for equivalent parts.

As illustrated in FIG. 9, paddle 64 basically comprises a plate folded about fold region 65 to form a U-shaped channel with a first leg 66 longer than the second leg 67 of the U-shape. A standard holster 20 or other carrier may be secured to the shorter leg 67 via an adjustable pivot connection 24 which is identical to that of the previous embodiments to allow the angle of holster 20 to be adjusted as described above in connection with FIGS. 1 to 7.

However, unlike the previous embodiments, a single hook 68 is provided at the lower edge of the first leg 66 to hook in place under a belt. With this version, a holster or other carrier can be worn inside the waistband as illustrated in FIG. 8, with leg 66 clipping over the belt outside the waistband.

Figure 10:
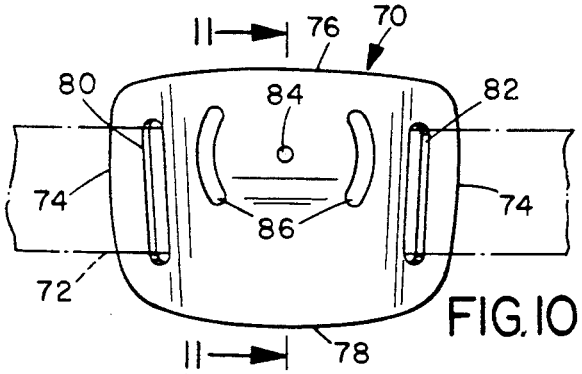
FIG. 10 is an outside view of a mounting device comprising a belt mounted plate according to a second embodiment of the invention.
Figure 11:
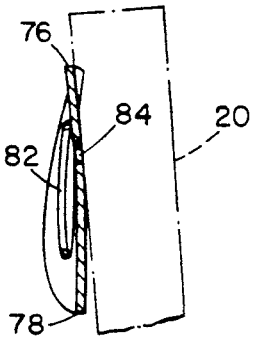
FIG. 11 is a sectional view taken on line 11—11 of FIG. 10.

FIGS. 10 to 13 illustrate a holster mounting device 70 according to a second embodiment of the invention for suspending a holster from a wearer's belt 72. The mounting device 70 comprises a single plate having opposite side edges 74 and first and second longitudinal edges 76, 78 extending between the side edges. The plate has a pair of aligned, belt receiving slots 80, 82 adjacent the respective side edges for slidably receiving a belt extending through the slots, as best illustrated in FIGS. 10 and 11.

As in the previous embodiment, the plate has an opening 84 located centrally between the side edges through which a suitable pivotal connector (not illustrated) extends for pivotally connecting the plate to a holster body. A pair of arcuate adjustment slots 86 are positioned symmetrically one on each side of the pivot opening 84 for receiving releasable fasteners or screws (not illustrated) as in the previous embodiment for releasably securing a holster in any selected angular position in a range defined by the length of the slots. The pivot opening 84 is located closer to the first edge 76 than the second edge 78 of the plate. As in the previous embodiment, use of the three hole slot pattern permits the adjustment of the angle of an attached holster to suit the wearer.

Figure 13:
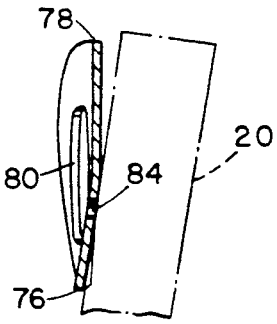
FIG. 13 is a sectional view taken on line 13—13 of FIG. 12.
Figure 12:
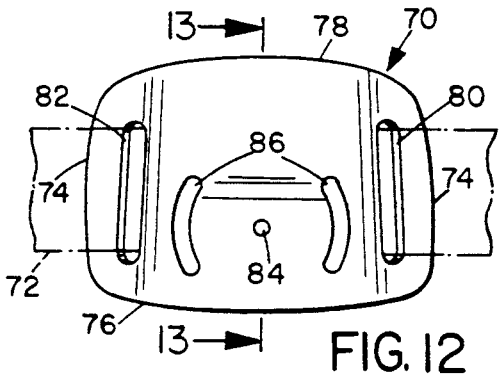
FIG. 12 shows the plate inverted on a belt for a low holster position.

The plate can be adjusted quickly and easily to provide two different carry heights in the same plate. This is achieved by removing the two outermost fastener screws completely, and rotating the plate through 180 degrees about the central pivot or screw until the second edge 78, rather than first edge 76, is uppermost, as illustrated in FIG. 13. Clearly, when the plate is oriented as illustrated in FIG. 10 a holster secured to pivot opening 84 will be carried higher on the body than a holster secured to opening 84 when the plate is rotated into the position of FIG. 12.

The plate itself is not completely flat but is curved to generally follow the body curvature at the waistline, as best illustrated in FIGS. 10 and 11. Thus, the side edges are curved inwardly to follow the rounded body contour around the waistline. Preferably, the plate also has a slight curvature between the opposite first and second edges 76 and 78, as illustrated in FIGS. 11 and 13, and edge 76 has a lip or bow-like contour between the opposite sides 74 of the plate. This configuration is arranged to provide a different amount of "cast off" or tilting of the pistol when it is carried in the high mode, with the plate orientated as in FIGS. 10 and 11, and in the low mode, with the plate orientated as in FIGS. 12 and 13.

The arched configuration adjacent edge 76 will fit into the waistline when edge 76 is positioned uppermost as illustrated in FIG. 9, placing the pistol grip vertically at the waist. When edge 76 is lowermost, as illustrated in FIG. 13, the same arch will act against the hips to tilt the pistol grip slightly outwardly. For example, a woman may prefer to carry the holster low on the hips and have the pistol's grips tilted further from her waist than a straight hipped man. The same plate can be configured to place the pistol's grips closer to the waist when carried high than when the pistol is carried low. The lip-like or arched contour along edge 76 ensures that it does not cut into the waist or hips of the wearer, which could cause discomfort. This arrangement provides a single mounting plate which provides a dual ride height as well as the dual cast-off appropriate for these two ride heights.

Due to the symmetrical nature of the plate's hole pattern, the ride height remains unchanged as the angle of the holster is adjusted via adjustment slots 86, as in the previous embodiment. Additionally, the same plate can be used for both right and left hand holsters.

The mounting devices described above provide a continuously adjustable holster angle in a predetermined range limited to the range of draw angles which are practical, and allow the holster to be securely fastened at the selected draw angle. The device is compact and stable enough for effective concealment, while allowing the holster to be worn outside the waistband. The paddle version can be easily attached to the waistband or belt, but is stable when inserted and resists inadvertent pulling out when drawing the gun. Both versions can be used with a wide range of different holster designs, and the plate design has the same angular adjustment capability as the paddle version while allowing for two different ride heights in the same mounting device. Both versions are comfortable and concealable.

Although some preferred embodiments of the present invention have been described above by way of example only, it will be understood by those skilled in the field that modifications may be made to the disclosed embodiments without departing from the scope of the invention, which is defined by the appended claims.

I claim:

1. A belt mountable holder, comprising:

a holster body having a handgun receiving pouch;

a mounting plate having a pair of aligned, belt receiving openings for slidably receiving a wearer's belt extending through the openings;

a pivotal connector pivotally connecting the holster body to the mounting plate for selective angular positioning of the holster body relative to the plate;

the pivotal connector including adjustment means for restricting angular positioning of the holster body to a predetermined range of angles and allowing continuous angular adjustment within said range;

fastener means for releasably securing the holster body in a selected angular position relative to the plate;

said plate having a central pivotal opening and a pair of arcuate slots positioned symmetrically on each side of said pivotal opening, said pivotal connector comprising a central pivotal extending through said pivot opening;

said adjustment means comprising first and second adjustment members extending transversely through said arcuate slots and moveable in opposite directions between opposite ends of said slots to control angular positioning of the holder body; and said fastener means comprising means for securing said adjustment members at selected positions in said slots.

2. The holster as claimed in claim 1, wherein the mounting plate is of generally rectangular shape having opposite side edges and opposite first and second peripheral edges extending between said side edges, and the belt receiving openings comprise a first slot adjacent one side edge of the plate and a second slot adjacent the opposite side edge of the plate.

3. The holster as claimed in claim 1, wherein the pivotal connector is located centrally between said side edges and closer to the first peripheral edge than the second peripheral edge of the plate, said fastener means being releasably mounted on said plate and said pivotal connector comprising means for allowing 360 degree rotation of said plate relative to said holster body on release of said fastener device for selectively positioning said plate relative to said holster body with said first peripheral edge uppermost or said second peripheral edge uppermost.

4. The holster as claimed in claim 1, wherein said plate includes a paddle having an upper end for securing to said holster body and a lower end for selectively hooking over a wearer's waistband.

5. The holster as claimed in claim 4, wherein the paddle has opposite side edges which taper inwardly towards the lower end of the paddle.

6. The holster as claimed in claim 4, wherein said paddle has retention means projecting towards said holster body for extending beneath the waistband of a wearer to retain the plate in position.

7. The holster as claimed in claim 6, wherein said retention means comprises at least one barb at one side edge of said paddle.

8. The holster as claimed in claim 7, wherein said paddle has a pair of barbs at its opposite side edges for extending beneath the waistband of a wearer.

9. The holster as claimed in claim 5, wherein said paddle is bent around a fold line to form a U-shaped channel having a first leg on one side of the channel for hooking over a belt or waistband and a second leg on the other side of the channel, the second leg being connected to the holster body, and opposite ends of said channel comprising said belt receiving openings for selectively receiving a belt extending through said channel.

10. The holster as claimed in claim 9, wherein the second leg is shorter than the first leg.

11. The holster as claimed in claim 9, wherein said first leg has retention means projecting towards said holster body for extending beneath the waistband of a wearer to retain the paddle in position.

12. The holster as claimed in claim 11, wherein said retention means comprise a pair of barbs located on opposite side edges of said first leg.

13. A carrying assembly for carrying one or more articles at a wearer's waistband, comprising:

a carrier body having a cavity for at least partially receiving at least one article to be carried;

a paddle member having a first end attached to said carrier body, opposite side edges and a second end for insertion inside a wearer's waistband with at least a portion of the paddle member located on the inside of the wearer's waistband and the carrier body suspended on the outside of the wearer's waistband; and a pair of spaced projections located at opposite side edges of the said portion of the paddle member;

each projection projecting towards said carrier body to form a ledge facing away from the second end of said paddle member, said ledge comprising means for positively engaging and catching against a waistband to resist removal of the paddle member from the waistband.

14. The assembly as claimed in claim 13, wherein each projection comprises a shaped portion of the respective side edge of the paddle member.

15. The device as claimed in claim 14, wherein each projection forms an indent at a junction between the projection and respective side edge, and the indent faces generally towards the first end of said paddle member.

16. A carrier assembly for carrying one or more articles at a wearer's waistband, comprising:

a carrier body;

a paddle member having a first end secured to said carrier body, opposite side edges and a second end for inserting inside a wearer's waistband with at least a second portion of the paddle member located on the inside of the wearer's waistband and the attached carrier body located on the outside of the wearer's waistband;

a pair of spaced projections formed at opposite side edges of the second portion of the paddle member and projecting towards said carrier body for engagement beneath a waistband for retaining the paddle member and attached carrier body in place at the wearer's waistband; and said paddle member has a width greater than that of the attached carrier body at the location of the projections at the opposite side edges of the inner leg of the paddle member, at least one of the projections being positioned outside the width of said attached carrier body and comprising means for extending beneath the waistband of a wearer on at least one side of the attached carrier body.

17. The assembly as claimed in claim 16, wherein the paddle member has a width which tapers downwardly towards said second end and said projections are directed away from said second end and towards said carrier body to engage on opposite sides of an attached carrier body.

18. A mounting device for suspending a carrier body from a wearer's waistband, comprising:

a paddle member having a U-shaped transverse cross-section with first and second legs on each side of the U-shape and a fold area connecting said legs;

the first leg comprising means for hooking over a wearer's waistband;

the second leg having pivotal connector means for pivotally securing the second leg to a carrier body;

the second leg of the paddle member having a pivot opening located centrally between its side edges for receiving a pivotal fastener for pivotally connecting said first leg to a holster body, and a pair of arcuate slots positioned symmetrically one on each side of said pivotal opening for slidably receiving a pair of releasable fasteners for releasably securing a holster body in a selected angular position relative to said paddle member.

19. The device as claimed in claim 18, wherein the first leg has at least one retention device for engagement beneath a waistband or belt for retaining the paddle member in place at the wearer's waistband.

20. The device as claimed in claim 18, wherein the first leg is longer than the second leg.

21. The device as claimed in claim 18, wherein the first leg has opposite side edges which taper inwardly towards the free end of the first leg.

22. The device as claimed in claim 18, wherein said first leg has an access opening overlying said pivot opening and a pair of arcuate access slots, each access slot overlying a respective one of said arcuate slots in said second leg for access to said fasteners.

23. The device as claimed in claim 18, wherein said retention device comprises at least one barb on one side edge of the first leg projecting towards the second leg for engaging beneath a wearer's waistband.

24. The device as claimed in claim 23, wherein the first leg has a pair of barbs positioned on its opposite side edges for engaging beneath a wearer's waistband on opposite sides of an attached carrier body.

25. A mounting device for suspending a carrier body from a wearer's waistband, comprising:

a paddle member having an inner leg, an outer support for securing to a carrier body, and connecting means for securing the inner leg to the outer support, the inner leg having opposite side edges and a first end for insertion inside a wearer's waistband with the inner leg located on the inside of the wearer's waistband and the outer support suspending the carrier body on the outside of the wearer's waistband;

a pair of prongs formed at opposite side edges of the inner leg of the paddle member and projecting towards said outer support for engagement beneath a waistband for retaining the paddle member and attached carrier body in place at the wearer's waistband; and each prong forming a ledge facing away from said first end, said ledge comprising means for positively engaging and catching against a waistband to resist removal of the paddle member from the waistband.

26. The device as claimed in claim 25, including a carrier body attached to said outer support.

* * * * *